United States Patent [19]

Kyser et al.

[11] Patent Number: 4,882,568

[45] Date of Patent: Nov. 21, 1989

[54] TOILET TISSUE ALERT SYSTEM

[76] Inventors: Jerry L. Kyser, 4410 Spring Hill; David D. Mears, 4405 Spring Hill, both of, Inkster, Mich. 48141

[21] Appl. No.: 198,505

[22] Filed: May 25, 1988

[51] Int. Cl.[4] ..... G08B 13/14

[52] U.S. Cl. ..... 340/568; 200/61.16; 242/57; 340/675

[58] Field of Search ..... 340/568, 675; 312/37-38; 200/61.16.61.19; 242/57

[56] References Cited

U.S. PATENT DOCUMENTS

| | | | |
|---|---|---|---|
| 3,817,611 | 6/1974 | Brown | 340/675 X |
| 3,948,715 | 4/1976 | Tokuno | 242/58.1 X |
| 4,113,197 | 9/1978 | Harrington et al. | 242/58.1 |
| 4,204,180 | 5/1980 | Usui et al. | 340/675 X |
| 4,422,402 | 12/1983 | Ogihara | 340/675 X |

*Primary Examiner*—Glen R. Swann, III
*Assistant Examiner*—Thomas J. Mullen, Jr.
*Attorney, Agent, or Firm*—Arnold S. Weintraub

[57] ABSTRACT

The invention teaches a sensing device arrangement for a tissue paper roll to give advance warning when the material forming the roll approaches the end. The present invention uses a sensing arrangement which comprises a bracket, a tissue paper roll retaining member, a means for detecting the end of the tissue roll and a signalling means for indicating the end of the tissue roll. The signalling means is operably connected to and activated by the detecting means, when there is a small amount of paper left on the roll, indicating to an attendant that it is necessary to change the paper roll.

8 Claims, 1 Drawing Sheet

TOILET TISSUE ALERT SYSTEM

BACKGROUND OF THE INVENTION

1. Field of the Invention

This invention relates generally to an end of the paper roll detection assembly, and in particular to an end of the paper roll detection assembly which automatically signals the approaching end of a toilet paper roll.

2. Prior Art

Conventionally, there have been many types of paper roll end detecting devices which indicate a small amount of remaining paper on a roll. Approaching the end of the paper roll is most often detected visually. However, such visual detection is often not practical in public rest rooms in locations such as gas stations, restaurants and the like.

The end of the paper roll signaling devices have been described by a number of inventors. Bolick, in U.S. Pat. No. 3,820,101, determines the end of a paper roll with the use of a radiation, such as light. The radiation path remains interrupted on the spool until only a predetermined amount of tape remains on the spool. Kishioka, U.S. Pat. No. 3,409,242 determines the diameter of a rolled sheet by pulses which are applied to a step-wave producing element, the output of which is applied to the density. This raises the voltage to a reference voltage level. In turn a signal is produced which can be utilized to recognize that a rolled sheet has run short of or exceeded a predetermined diameter. Hiler, U.S. Pat. No. 3,492,732 describes a supply roll with two follower members which engage the circumference surface of the web and web support respectively. The follower members sense a differential quantity of the web material on the roll and according to predetermined conditions provide an indication thereof. Nedstedt, U.S. Pat. No. 4,620,184 details a sensing device on material rolls, used to give advance warning when the material web forming the roll approaches its end. The sensing device comprises a magnetic field generating element and a sensing device such as a heavy current switch. The heavy current switch which is acted upon at a certain predetermined field strength, indicating that roll replacement is necessary. Finally, Usui, U.S. Pat. No. 4,204,180 describes an adjustable paper roll retaining member and detecting bar. When paper is consumed the paper roll core lowers toward the retaining member until the core is aligned with the detecting bar. The detecting bar enters into the hollow core actuating a switch that generates a signal. This signal indicates that a predetermined amount of paper remains on the roll.

The invention provides adequate detection of the end of the roll, and signals personnel in an area remote to the rest room that the tissue is running low, thus enabling the personnel to replace the tissue before customers are inconvenienced.

SUMMARY OF THE INVENTION

The present invention defines an end of a paper roll alert system comprising:

a bracket which holds an elongated tissue paper roll retaining member; a normally open electromagnetic switch mounted on the roll retaining member, and means for detecting the end of the tissue roll.

The means for detecting is mounted on the bracket and extends the length of a tissue roll. The detection means is operably connected to a signalling means for indicating the end of the tissue roll. The signalling means is operable upon the closing of the switch.

For a more complete understanding of the present invention, reference is made to the following detailed description and accompanying drawing. In the drawing like referenced characters refer to like parts throughout the several means in which:

DESCRIPTION OF THE PREFERRED EMBODIMENT

Figure 1:
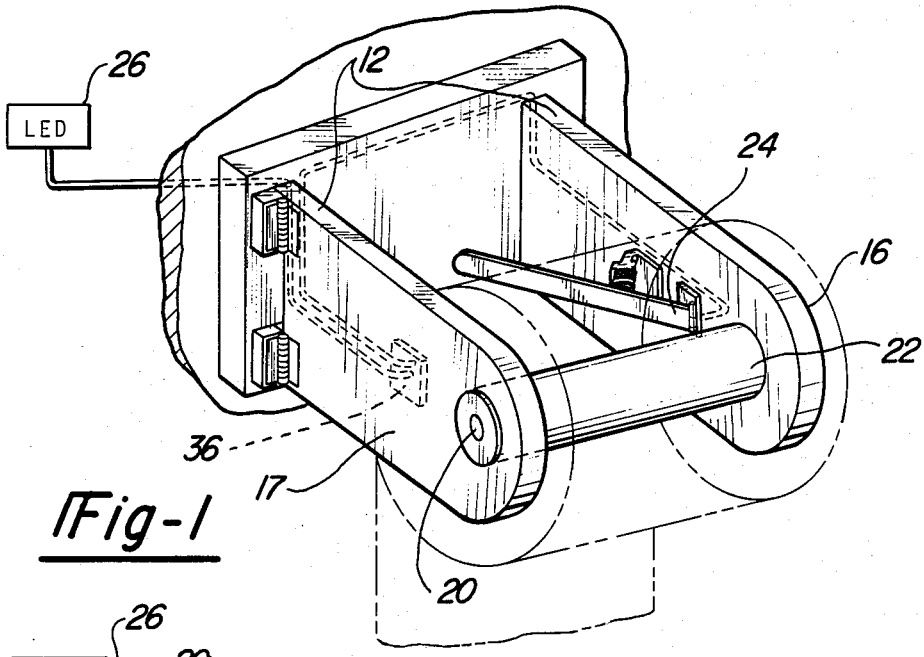
FIG. 1 illustrates a perspective view of an alert system in accordance with the present invention.
Figure 2:
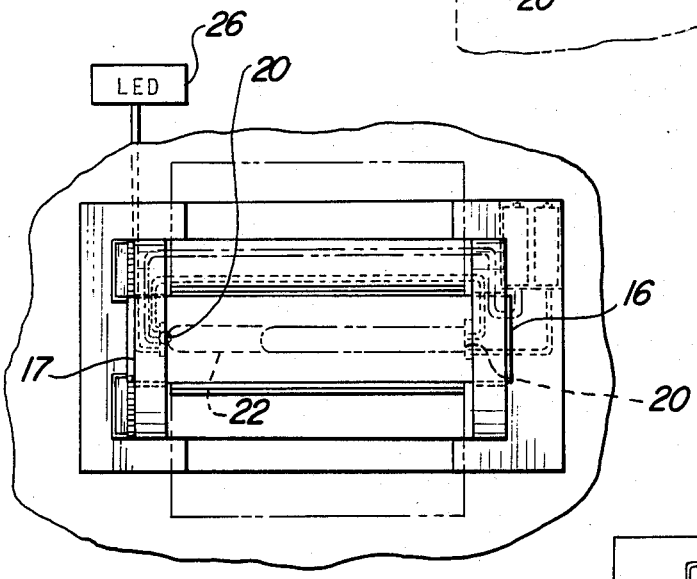
FIG. 2 illustrates a front view of the bracket and roll retaining member.

Now and with reference to the drawing, and in particular, FIG. 1 there is depicted a preferred embodiment of the present invention which includes a bracket 12; an elongated tissue paper roll retaining member 22, means for mounting the retaining member to the bracket 20; means 24 for detecting the end of the tissue roll, said means being mounted on the bracket; and signalling means 26 operably connected to the detecting means.

As shown in FIG. 1, the bracket generally comprises a back member 14 and two side members 16, 17, the side members projecting at right angles to the back member, one side member 16 having a hinge and a second side member 17 comprising a metal stationary member containing an electromagnetic switch 36. Located in each side member is a grooved notch or hole 20, to receive an elongated roll retaining member 22. The bracket may be of a plastic or metal material.

Figure 3:
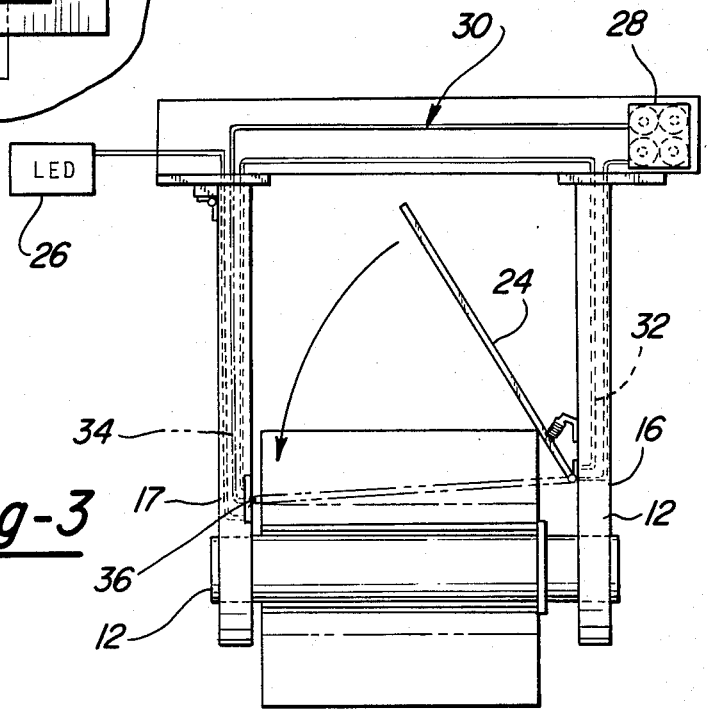
FIG. 3 illustrates a top view of the bracket and housing for the attached power supply and signalling means.

FIG. 3 shows a top view of the holder and attached circuitry. The detecting bar 24 is connected to the hinged side member 16 and is located behind the paper roll. The bar is biassed toward the center of the roll by means of a spring 25 or the like and extends over the opposite side of the holder 17. So located, the bar does not interfere with the rolling action of the paper roll. As the thickness of the roll decreases, the bar 24 moves closer to the opposite side 17 of the holder. When the roll is reduced to a given thickness the bar comes in contact with the opposite side of the holder 17, contacting the electromagnetic switch and, thus, closing the circuit, to activate the signalling means 26, such as a light emitting diode or sound alarm, or both.

As shown in FIG. 3 the signalling means 26 is powered by an electrical power source 28, such as, but not limited to a battery pack comprising a plurality of dry cell batteries or the like, a wall outlet or the like. Where a battery is used, the power supply is contained in a housing 30 mounted above the bracket 12, and connected by wires 32 to the bracket. A wire 32 supplies current to the holder and is connected to the hinged end member and detecting bar. A second wire 34 is connected to a switch which is normally open, at the opposite metal end and runs back to the power supply. The detecting bar mechanically moves into place to signal an empty roll as a consequence of paper depletion. No electric circuitry is necessary to cause the movement of detecting bar. When the detecting bar touches the metal end of the bracket the electromagnetic switch is closed, the circuit is completed, thus activating the alert system 26.

The toilet tissue alert system hereof is reliable, economical to use, practical and convenient. The mechanical design of the device is reliable. The device is economical, as it runs on batteries or electricity at a nominal cost.

The warning light or alarm renders the device practical and convenient. The light can be placed in an area remote to a rest room, such as a cashier's area, housekeeping supply room or reception area to notify personnel that tissue supply is low in a rest room. Personnel can readily notice the signal and replace the tissue to prevent customer inconvenience.

We claim:

1. A paper roll holding device and alert system comprising:

a bracket having a back member and two side members, each side member having a notch formed therein;

an elongated tissue paper roll retaining member being retained between the notches in each side member of the bracket;

means for detecting the end of a tissue roll, said means connected to one bracket side member and extending the width of a tissue roll to contact the opposite bracket side member when the tissue roll is depleted; and a signalling means indicating the end of the tissue roll, the signalling means being operably connected to the detecting means.

2. The device of claim 1 wherein the detecting means comprises a detecting bar, connected to one side member of the bracket and extending over a tissue roll and above the opposite side member of the tissue paper bracket.

3. The device of claim 2 further comprising an electrical power source which is operably connected to the detecting bar and each side member such that when the detecting bar comes into contact with said opposite side member, the signalling means is activated.

4. The device of claim 3 further comprising: a switch located on the bracket, the switch being operably connected to the power source and activated by the detecting bar.

5. A material roll holding device and alert system comprising:

a bracket having a back member and two side members, each side member having a notch formed therein;

an elongated roll retaining member being retained between the notches in each side member of the bracket;

a means for detecting the end of a material roll, said means connected to one bracket side member and extending the width of a material roll to contact the opposite bracket side member when the roll is depleted; and a signalling means for indicating the end of the material roll, the signalling means being operably connected to the detecting means.

6. The device of claim 5 wherein the detecting means comprises a detecting bar, connected to one side member of the bracket and extending over a material roll and above the opposite side member of the bracket.

7. The device of claim 6 further comprising an electrical power source, which is operably connected to the detecting bar and to each side member, such that when the detecting bar contacts said opposite side member, the signalling means is activated.

8. The device of claim 7 further comprising a switch located on the bracket and operably connected to the power source and activated by the detecting bar.

* * * * *